US011466426B2

(12) United States Patent
Davis et al.

(10) Patent No.: US 11,466,426 B2
(45) Date of Patent: Oct. 11, 2022

(54) MATERIAL MOVING MACHINES AND PILOT HYDRAULIC SWITCHING SYSTEMS FOR USE THEREIN

(71) Applicant: Caterpillar Trimble Control Technologies LLC, Dayton, OH (US)

(72) Inventors: Kyle Davis, Xenia, OH (US); Richard Paul Piekutowski, Huber Heights, OH (US)

(73) Assignees: CATERPILLAR TRIMBLE CONTROL TECHNOLOGIES LLC, Dayton, OH (US); TRIMBLE, INC., Sunnyvale, CA (US)

( * ) Notice: Subject to any disclaimer, the term of this patent is extended or adjusted under 35 U.S.C. 154(b) by 673 days.

(21) Appl. No.: 16/407,888

(22) Filed: May 9, 2019

(65) Prior Publication Data

US 2020/0354923 A1 Nov. 12, 2020

(51) Int. Cl.
*E02F 3/84* (2006.01)
*E02F 3/76* (2006.01)
(Continued)

(52) U.S. Cl.
CPC ..... *E02F 3/844* (2013.01); *E02F 3/7609* (2013.01); *E02F 3/7618* (2013.01);
(Continued)

(58) Field of Classification Search
CPC ..... F15B 13/0433; F15B 2211/355; E02F 9/2285
See application file for complete search history.

(56) References Cited

U.S. PATENT DOCUMENTS 4,870,892 A * 10/1989 Thomsen ..... F15B 11/006 91/361
5,138,838 A * 8/1992 Crosser ..... F15B 21/087 60/426
(Continued)

FOREIGN PATENT DOCUMENTS

| | | |
|---|---|---|
| DE | 3225003 A1 | 1/1984 |
| DE | 10254688 B3 | 4/2004 |
| JP | 08093713 | 9/1996 |

OTHER PUBLICATIONS

International Search Report and Written Opinion pertaining to International Application No. PCT/US2020/031580 dated Aug. 19, 2020.

*Primary Examiner* — Thomas E Lazo
(74) *Attorney, Agent, or Firm* — Dinsmore & Shohl LLP

(57) ABSTRACT

In accordance with one embodiment of the present disclosure, a material moving machine comprises a pilot hydraulic switching system. The pilot hydraulic switching system comprises a control unit, a first directional valve, and a second directional valve. The control unit is configured to operate the first and second directional valves to shift a variable position actuator valve between a static state, a retract state, and an extend state. The actuator valve comprises a first and second control element. In the retract and extend states, the first and second directional valves control fluid flow to the variable position actuator valve with a positive net pressure on either the first or second control elements and a negative net pressure on the other control element to move the material moving implement. In the static state, the first and second directional valves control fluid flow equally on the first and second control elements.

25 Claims, 4 Drawing Sheets

(51) Int. Cl.
*E02F 9/22* (2006.01)
*F15B 13/043* (2006.01)

(52) U.S. Cl.
CPC ..... *E02F 9/2225* (2013.01); *E02F 9/2267* (2013.01); *E02F 9/2271* (2013.01); *E02F 9/2275* (2013.01); *E02F 9/2285* (2013.01); *F15B 13/0433* (2013.01); *F15B 2211/355* (2013.01)

(56) References Cited

U.S. PATENT DOCUMENTS

| | | | | |
|---|---|---|---|---|
| 6,035,241 | A * | 3/2000 | Yamamoto | E02F 3/844 172/45 |
| 6,109,284 | A * | 8/2000 | Johnson | E02F 9/2228 137/1 |
| 6,508,268 | B1 | 1/2003 | Kouketsu | |
| 7,353,743 | B2 | 4/2008 | Bugel et al. | |
| 8,505,436 | B2 | 8/2013 | Teschke | |
| 2012/0152575 | A1* | 6/2012 | Hand | E02F 9/2285 172/812 |
| 2015/0050110 | A1 | 2/2015 | Matsuyama et al. | |
| 2016/0025215 | A1 | 1/2016 | Thoms et al. | |

* cited by examiner

MATERIAL MOVING MACHINES AND PILOT HYDRAULIC SWITCHING SYSTEMS FOR USE THEREIN

BACKGROUND

The present disclosure relates to material moving machines and, in some embodiments, to material moving machines including material moving implements, such as bulldozers including material moving implements. Such bulldozers, for the purposes of defining and describing the scope of the present application, comprise a material moving implement subject to vertical movement (i.e., raise and lower movement), pivoting movement, and tilting movement. For example, and not by way of limitation, many types of bulldozers comprise a hydraulically or pneumatically or electrically controlled material moving implement that can be manipulated by controlling the raise, the pivot, and/or the tilt functions of a implement support assembly of the bulldozer.

BRIEF SUMMARY

According to the subject matter of the present disclosure, material moving machines may be provided with a pilot hydraulic switching system comprising a switching system control unit, a first directional valve, and a second directional valve. The control unit operates the first directional valve and the second directional valve such that a variable position valve is shifted between a static state, a retract state, and an extend state.

In accordance with one embodiment of the present disclosure, a material moving machine is provided comprising a machine chassis, an implement support assembly, a material moving implement coupled to the machine chassis via the implement support assembly, a hydraulic fluid handling system, a variable position actuator valve, and a pilot hydraulic switching system. The implement support assembly comprises an implement actuator that is configured to move the material moving implement relative to the machine chassis. The hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line. The variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line. The pilot hydraulic switching system comprises a switching system control unit, a first directional valve in fluid communication with the extend pilot line, and a second directional valve in fluid communication with the retract pilot line. The switching system control unit is configured to operate the first directional valve and the second directional valve. The first directional valve and the second directional valve are configured to shift the variable position actuator valve between a static state, a retract state, and an extend state. In the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator. In the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator. In the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

In accordance with another embodiment of the present disclosure, a bulldozer comprises a machine chassis, an implement support assembly, a translational chassis drive assembly configured to translate the material moving machine in a translational direction of operation, a material moving implement coupled to the machine chassis via the implement support assembly, a hydraulic fluid handling system, a variable position actuator valve, and a pilot hydraulic switching system. The implement support assembly comprises an implement actuator that is configured to move the material moving implement relative to the machine chassis. The implement support assembly and the material moving implement are configured such that the material moving implement displaces material in an advancing path of the material moving implement as the material moving machine is translated by the drive assembly in the translational direction of operation. The hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line. The variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line, the variable position actuator valve further comprises an opposing flow path mode, a counter flow path mode, and a blocked flow path mode. The pilot hydraulic switching system comprises a switching system control unit, a first directional valve in fluid communication with the extend pilot line, and a second directional valve in fluid communication with the retract pilot line, the first directional valve and the second directional valves each further comprise a delta net increase position, a neutral position, and a delta net decrease position. The switching system control unit is configured to operate the first directional valve and the second directional valve. The first directional valve and the second directional valve are configured to shift between the delta net increase position, the neutral position, and the delta net decrease position such that the variable position actuator valve is shifted between a static state, a retract state, and an extend state. The switching system control unit is configured to determine a first pulse width modulation percentage of the first directional valve and a second pulse width modulation percentage of the second directional valve as a percentage amount of pulse width modulation required to achieve a desired delta pilot pressure such that the switching system control unit is configured to shift the variable position actuator valve to either the static state, the extend state or the retract state based on a predetermined target range. The switching system control unit comprises a predetermined pulse width modulation table identifying a plurality of desired delta pilot pressures and corresponding target current outputs required for the first directional valve and the second directional valve to control fluid flow into the first control element and the second control element of the variable position actuator valve. The switching system control unit is configured to determine whether the variable position actuator valve will achieve one of the plurality of desired delta pilot pressures for the static state, the retract state, or the extend state within a predetermined period of time and shift the variable position actuator valve to the static state when the desired delta pilot pressure is not achievable within the predetermined period of time. In the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator. In the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator. In the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

In accordance with another embodiment of the present disclosure, a material moving machine comprises a material moving implement, an implement actuator operatively coupled to the material moving implement, a hydraulic fluid handling system, a variable position actuator valve, and a pilot hydraulic switching system. The hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line. The variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line. The pilot hydraulic switching system comprises a switching system control unit, a first directional valve in fluid communication with the extend pilot line, and a second directional valve in fluid communication with the retract pilot line. The switching system control unit is configured to operate the first directional valve and the second directional valve. The first directional valve and the second directional valve are configured to shift the variable position actuator valve between a static state, a retract state, and an extend state. In the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator. In the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator. In the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

Although the concepts of the present disclosure are described herein with primary reference to the bulldozer illustrated in FIG. 1 as a material moving machine, it is contemplated that the concepts will enjoy applicability to any type of material moving machine, regardless of its particular mechanical configuration. For example, and not by way of limitation, it is contemplated that the concepts of the present disclosure will enjoy applicability to a backhoe loader including a backhoe linkage, a motor grader, a skid steer, an excavator, a paver, a loader, a trencher, a scraper, a drill, a crusher, a dragline, a crane, or any type of machine that includes an implement for moving material.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to material moving machines configured to execute material moving tasks such as those involving material moving operations. For the purposes of the present disclosure, a material moving machine is designed to excavate, distribute, smooth, or otherwise move a material. Examples of such machines include, but are not limited to, excavators, backhoe loaders, bulldozers, pavers, motor graders, loaders, trenchers, scrapers, drills, crushers, draglines, cranes, or any type of machine that includes an implement for moving material. Contemplated materials include, but are not limited to, soil or other surface-based earth materials, subterranean materials, including materials to be mined, and construction aggregates, including, for example, substrate materials and paving materials.

More particularly, the material moving machines may include a machine chassis and a hydraulically controlled material moving implement that can be manipulated by a joystick or other means in an operator control station of the machine. The user of the machine may control the lift, tilt, angle, and pitch of the implement. In addition, one or more of these variables may also be subject to partially or fully automated control based on information sensed or received by a dynamic sensor of the machine such as a position sensor.

Figure 1:
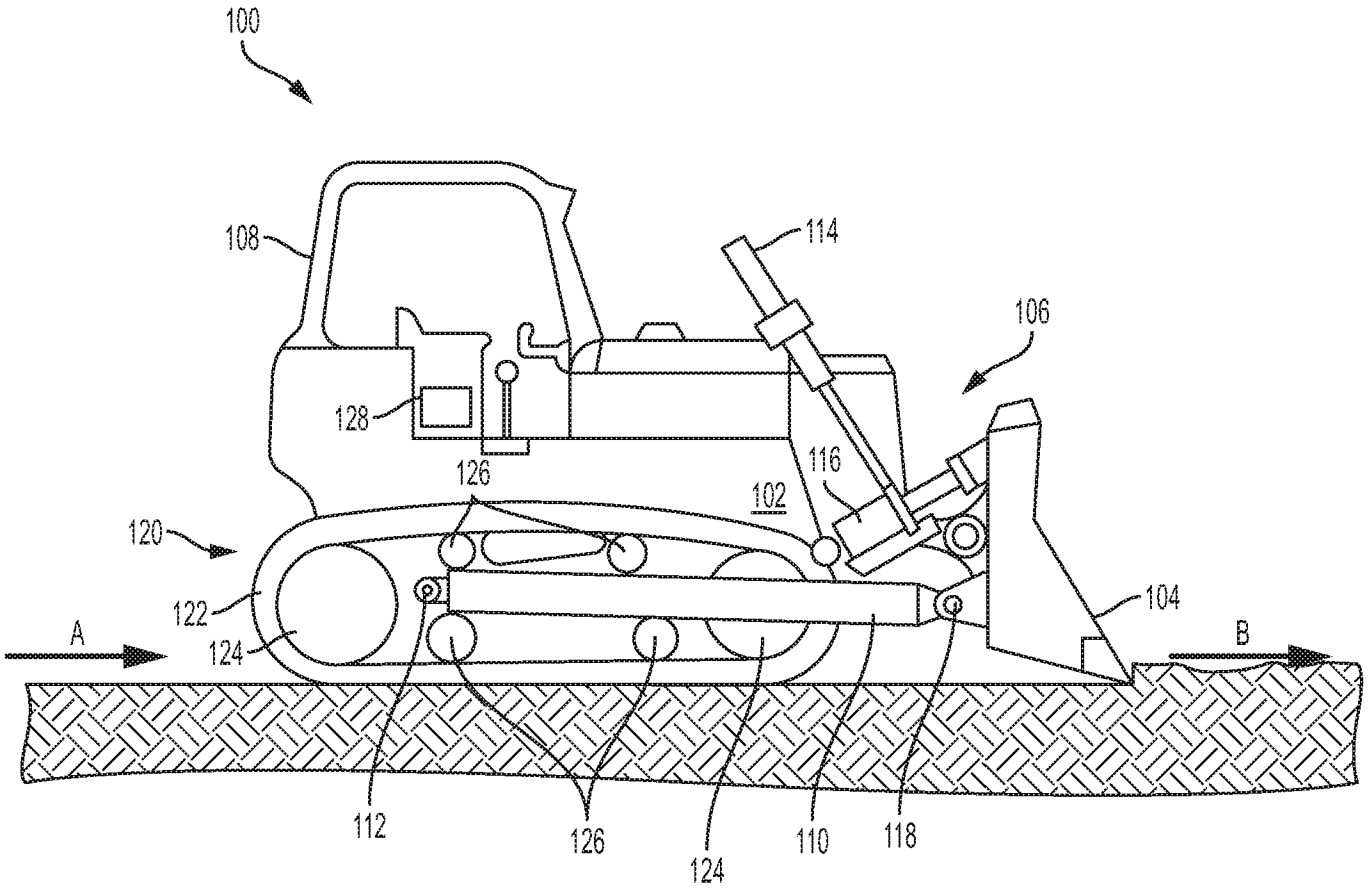
FIG. 1 is a side view of a bulldozer incorporating aspects of the present disclosure.

Referring to FIG. 1, a material moving machine 100 is illustrated in the form of a bulldozer, but this should be understood to be a non-limiting example of a particular type of material moving machine 100 contemplated by the present disclosure. The material moving machine 100 comprises a machine chassis 102, a material moving implement 104 supported by left and right-side portions of an implement support assembly 106, and a cab 108. Although only the right-side portion of the implement support assembly 106 is illustrated in FIG. 1, it is noted that the left and right-side portions will often comprise corresponding identical left and right-side hardware including, for example, an implement push arm 110 pivotally attached to the machine chassis 102 at a pivot position 112, and an implement actuator 114. The implement actuator comprises an implement lift actuator for raising and lowering the material moving implement 104 in relation to the machine chassis 102, and sometimes an implement pivot actuator 116 for pivoting the material moving implement 104 about a pivot connection 118. The implement support assembly 106 comprises the implement actuator 114. It should be appreciated that the cab 108 is where an operator may manually operate various controls to control the operation of the material moving machine 100. The material moving machine 100 further comprises a pilot hydraulic switching system 202 (FIGS. 2-4), which in turn comprises a switching system control unit 128, a hydraulic fluid handling system 204 (FIGS. 2-4) and a variable position actuator valve 206 (FIGS. 2-4), as discussed in greater detail below.

The material moving machine 100 further comprises a translational chassis drive assembly 120, which, in the bulldozer embodiment of FIG. 1 comprises a track 122, a plurality of track drive rollers 124, and a pair of track idler rollers 126. These components cooperate to translate the material moving machine in a translational direction of operation A. Further, the implement support assembly 106 and the material moving implement 104 are configured such that the material moving implement 104 displaces material in an advancing path B of the material moving implement 104 as the material moving machine 100 is translated by the translational chassis drive assembly 120 in the translational direction of operation A, which is the case in the illustrated bulldozer embodiment and other similarly configured material moving machines 100. As is illustrated in FIG. 1, the advancing path B of the material moving implement may be parallel to the translational direction of operation A of the material moving machine 100.

In many instances, the translational chassis drive assembly 120 is configured to translate the material moving machine 100 at a translational velocity of at least about 2.0 m/s (4.5 mph), and often more than 2.5 m/s (5.5 mph), in the translational direction of operation A. As will be described in further detail below with reference to FIGS. 2-4, the variable position actuator valve 206 and the pilot hydraulic switching system 202 are structurally configured to cooperate to shift the variable position actuator valve between a static state 200, an extend state 300, and a retract state 400 as the material moving machine 100 translates at or above these translational velocities.

Contemplated machine chassis actuators may be operatively coupled to at least one component of the machine chassis 102, or the material moving implement 104 or, in some embodiments, to another actuated component of the material moving machine 100, such as, for example, the cab 108. Although the concepts of the present disclosure are applicable to any of a variety of implement actuators, including those which are or are not coupled to a material moving implement, the concepts of the present disclosure are described herein with primary reference to the implement actuator 114.

Figure 2:
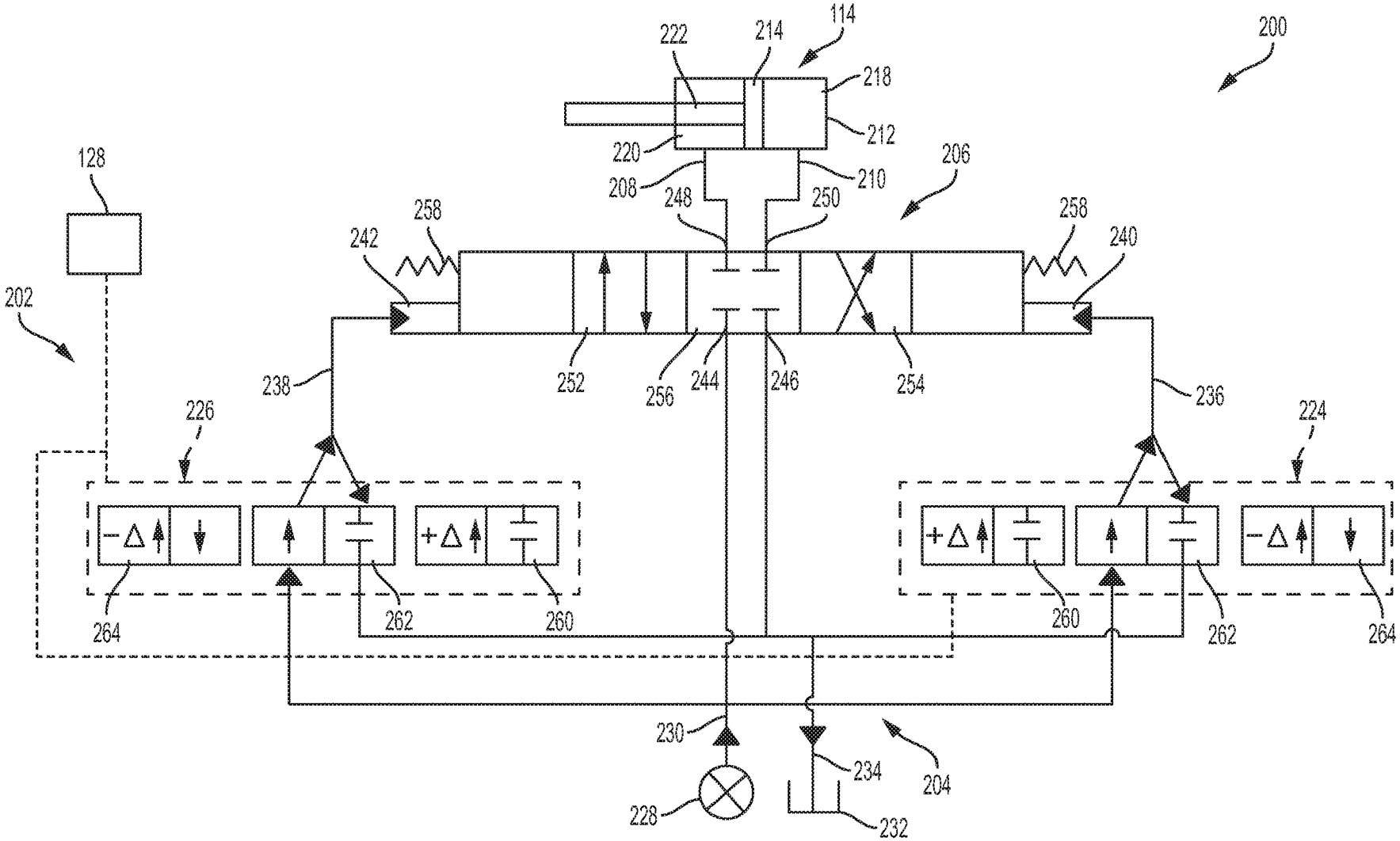
FIGS. 2-4 are schematic illustrations of the manner in which an implement actuator, hydraulic fluid handling system, variable position actuator valve, and pilot hydraulic switching system may be configured for use with a material moving machine of the present disclosure.
Figure 3:
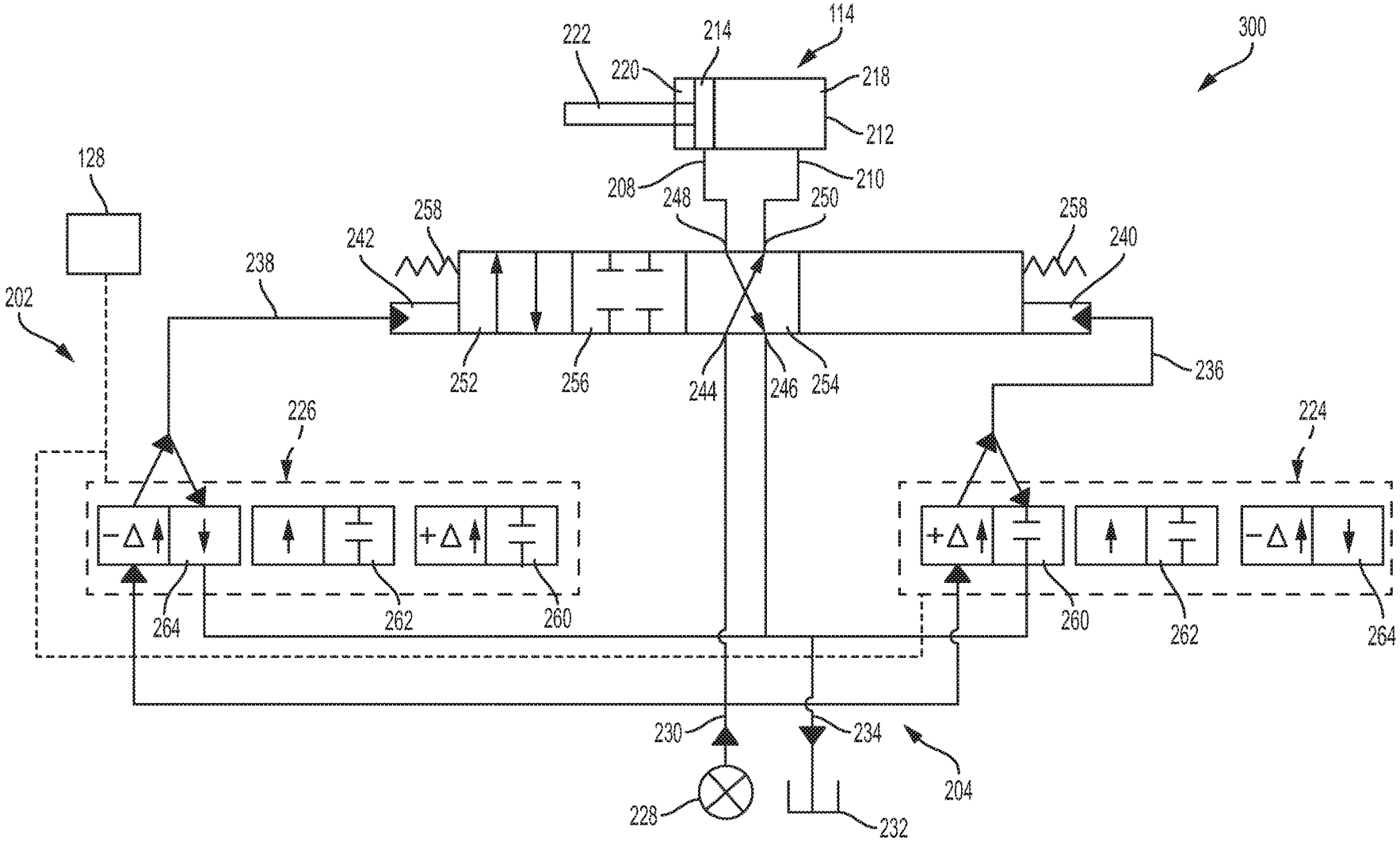
Figure 4:
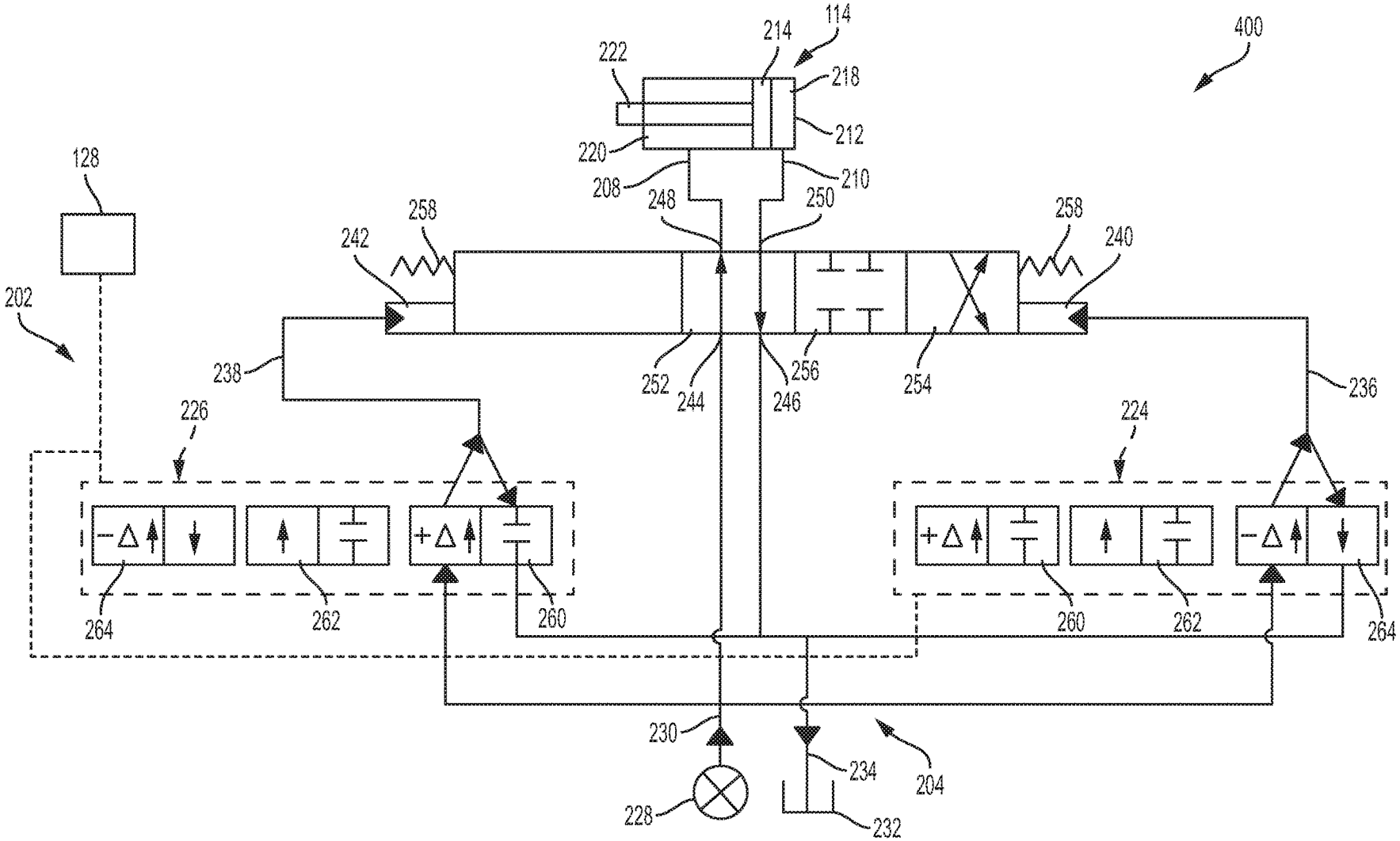

Referring now to FIGS. 2-4, a schematic illustrations of the manner in which the implement actuator 114, the pilot hydraulic switching system 202, the hydraulic fluid handling system 204, and the variable position actuator valve 206 may be configured for use with the material moving machine 100 will now described. The implement actuator 114 may comprise an actuator cylinder and the actuator cylinder may be configured to move between extended and retracted positions in response to flow of hydraulic fluid into and out of the actuator cylinder by way of a first and second actuator lines 208, 210. In some embodiments, the implement actuator 114 may comprise an actuator housing 212, a piston 214, a head end chamber 218, a rod end chamber 220 and a piston rod 222. The piston 214 may be slidably received in the actuator housing 212. The piston 214 may divide the internal chamber of the actuator housing 212 into a head end chamber 218 and a rod end chamber 220. Pressurized hydraulic fluid may flow into and out of the head and the rod end chambers 218, 220 to create a pressure differential between them that can cause movement of the piston rod 222 and thereby extend and retract the implement actuator 114.

Still referring to FIGS. 2-4, the variable position actuator valve 206 of the material moving machine 100, while depicted in FIGS. 2-4 as a three-way four port proportional valve, may be any proportional modulating control spooled valve and may comprise a plurality of positions such as three positions, four positions, seven positions, and/or the like and a plurality of ports, such as, without limitation, three ports, four ports, seven ports, and/or the like. The pilot hydraulic switching system 202 comprises the switching system control unit 128, a first directional valve 224, and a second directional valve 226, as will be described in further detail below. In some embodiments, the first directional valve 224 and the second directional valve 226 may each be a proportional valve. Further, in some embodiments, the first directional valve 224 and the second directional valve 226 may each be a solenoid actuated valve. As such, the solenoid actuated valve may be an electromechanically operated valve controlled by an electric current through the solenoid, in which in the case of a two-port valve, which may be contemplated in the first directional and second directional valves 224, 226, the flow of fluid may be switched depending on the desired response command in the variable position actuator valve 206. Further, the first directional valve 224 and the second directional valve 226 may be configured to increase speed and responsiveness of the pilot hydraulic switching system 202 which in turn shifts the variable position actuator valve 206 quicker by using unbalanced pressures at the variable position actuator valve 206 to cause the variable position actuator valve 206 to shift by reducing pressure, which is faster than increasing pressure and current, as discussed in greater detail herein.

The hydraulic fluid handling system 204 comprises a hydraulic fluid pump 228, a pump line 230 fluidly coupled to the hydraulic fluid pump 228, a hydraulic fluid tank 232, and a tank line 234 fluidly coupled to the hydraulic fluid tank 232. The hydraulic fluid handling system 204 further comprises the first actuator line 208 fluidly coupled to the implement actuator 114, the second actuator line 210 fluidly coupled to the implement actuator 114, an extend pilot line 236, and a retract pilot line 238, as discussed in greater detail herein. It should be appreciated that the hydraulic fluid handling system 204, the variable position actuator valve 206, the first and second directional valves 224, 226 and the implement actuator 114 are configured to source hydraulic fluid from the hydraulic fluid pump 228 and dispense hydraulic fluid to the hydraulic fluid tank 232.

Further, it should be appreciated that the first directional valve 224 and the second directional valve 226 are in direct or indirect fluid communication with the hydraulic fluid pump 228 and the hydraulic fluid tank 232. That is, the fluid communication may be a direct or indirect connection to the first directional valve 224 and/or the second directional valve 226, meaning that it may be envisioned that the hydraulic fluid pump 228 and/or the hydraulic fluid tank 232 do not necessarily need to be directly connected to the first and/or the second directional valves 224, 226.

Still referring to FIGS. 2-4, the variable position actuator valve 206 comprises a first control element 240 fluidly coupled to the extend pilot line 236 and a second control element 242 fluidly coupled to the retract pilot line 238. The variable position actuator valve 206 further comprises a pump port 244 fluidly coupled to the pump line 230, a tank port 246 fluidly coupled to the tank line 234, a first actuator-side port 248 fluidly coupled to the first actuator line 208, and a second actuator-side port 250 fluidly coupled to the second actuator line 210. In some embodiments, the variable position actuator valve 206 may comprise an opposing flow path mode 252, a counter flow path mode 254, and a blocked flow path mode 256. Moreover, the variable position actuator valve 206 may be a proportional control valve. As such, the variable position actuator valve 206 may be fluid pressure operated and/or pneumatic pressure operated. Moreover, the variable position actuator valve 206 may be biased to the blocked flow path mode 256 by a pair springs 258 and/or by other means as discussed herein and/or that one skilled in the art would recognize. It should be appreciated that the variable position actuator valve 206 may be disposed anywhere on the material moving machine 100.

In some embodiments, the first and second directional valves 224, 226 of the hydraulic fluid handling system 204 are fluidly coupled to the pump line 230 with the pump port 244 of the variable position actuator valve 206 such that the first directional valve 224, the second directional valve 226, and the pump port 244 of the variable position actuator valve 206 are fluidly coupled to a common pump source. Further, in other embodiments, the first and second directional valves 224, 226 are also fluidly coupled to the tank line 234 with the tank port 246 of the variable position actuator valve 206 such that the first directional valve 224, the second directional valve 226, and the tank port 246 of the variable position actuator valve 206 are fluidly coupled to a common tank source.

In yet further embodiments, the first and second directional valves 224, 226 are fluidly coupled to the pump line 230 with the pump port 244 of the variable position actuator valve 206 such that the first directional valve 224, the second directional valve 226, and the pump port 244 of the variable position actuator valve 206 are fluidly coupled to a common pump source and the first and second directional valves 224, 226 are fluidly coupled to the tank line 234 with the tank port 246 of the variable position actuator valve 206 such that the first directional valve 224, the second directional valve 226, and the tank port 246 of the variable position actuator valve 206 are fluidly coupled to a common tank source.

Still referring to FIGS. 2-4, the switching system control unit 128 operates the first directional valve 224 and the second directional valve 226 between a static state 200, an extend state 300, and a retract state 400. The switching system control unit 128 may be configured to regulate a pilot hydraulic pressure of the pilot hydraulic switching system 202 based on a predetermined target region for each of the static state 200, the extend state 300, and the retract state 400.

In the static state 200, the first and second directional valves 224, 226 control fluid flow to the variable position actuator valve 206 to drive pressurized fluid in the retract pilot line 238 and the extend pilot line 236 simultaneously and equally against the first control element 240 and the second control element 242 of the variable position actuator valve 206, as described in greater detail herein. In the extend state 300, the first and second directional valves 224, 226 control fluid flow to the variable position actuator valve 206 to drive pressurized fluid in the retract pilot line 238 and the extend pilot line 236 simultaneously with a positive net pressure of pressurized fluid on the first control element 240 of the variable position actuator valve 206 and a negative net pressure on the second control element 242 of the variable position actuator valve 206, as described in greater detail herein. In the retract state 400, the first and second directional valves 224, 226 control fluid flow to the variable position actuator valve 206 to drive pressurized fluid in the retract pilot line 238 and the extend pilot line 236 simultaneously with a positive net pressure on the second control element 242 of the variable position actuator valve 206 and a negative net pressure on the first control element 240 of the variable position actuator valve 206, as described in greater detail herein.

Still referring to FIGS. 2-4, the switching system control unit 128 is configured to operate the first directional valve 224 and the second directional valve 226 to shift the variable position actuator valve 206 between the static state 200 (FIG. 2), the extend state 300 (FIG. 3), and the retract state 400 (FIG. 4). The first directional and the second directional valves 224, 226 may each further have a delta net increase position 260, a neutral position 262, and a delta net decrease position 264. The switching system control unit 128 may be configured to control the first and second directional valves 224, 226 to shift between the delta net increase position 260, the neutral position 262, and the delta net decrease position 264, which is a normal or non-energized position, as described in greater detail herein.

As such, the switching system control unit 128 may be configured to complete a comparison of (i) a first target current output of the first directional valve 224 to a first actual current output to the first directional valve 224 via a first pulse width modulation percentage to the first directional valve 224 to (ii) a second target current output to the second directional valve 226 to a second actual current output to the second directional valve 226 via a second pulse width modulation percentage to the second directional valve 226, and controls the variable position actuator valve 206 based on the results of the comparison.

The switching system control unit 128 may be furthered configured to shift the variable position actuator valve 206 to the static state 200 using the first and the second directional valves 224, 226 when the comparison exceeds a predetermined failure threshold. It should be appreciated that a predetermined failure threshold may be a predetermined value that indicates an electrical failure such that when the comparison may be completed and the value may be outside the predetermined value, the system's fail safe may be to control the variable position actuator valve 206 to the static state 200.

The switching system control unit 128 may also be configured to shift the variable position actuator valve 206 to the static state 200 when the first actual current output or the second actual current output fail to meet the first target current output or the second target current output. By way of example and not limitation, the switching system control unit 128 may shift the variable position actuator valve 206 to the static state 200 due to sudden electrical loss or any other system malfunction that may prevent the first directional and the second directional valves 224, 226 from achieving the target current.

The switching system control unit 128 may be further configured to determine an open or a short in the pilot hydraulic switching system 202 based on determining the first pulse width modulation percentage or the second pulse width modulation percentage required for the first or the second actual current output required to achieve the first or the second target current output. When the open or the short is determined, the switching system control unit 128 may shift the variable position actuator valve 206 to the static state 200. For example, the switching system control unit 128 may shift the first and the second directional valves 224, 226 to the delta net decrease position 264, which in turn may shift the variable position actuator valve 206 to the static state 200. In some embodiments, the switching system control unit 128 may determine the open or the short by determining whether, either an amount of time and/or a current required to meet the target, exceeds a target time or the current required, which may indicate that there may be either an open or a short.

The switching system control unit 128 may be configured to determine a first pulse width modulation percentage of the first directional valve 224 and a second pulse width modulation percentage of the second directional valve 226 as a percentage amount of pulse width modulation required to achieve a desired delta pilot pressure. Based on a predetermined target range, the variable position actuator valve 206 may be shifted to either the static state 200, the extend state 300 or the retract state 400. As such, the desired delta pilot pressure may be predetermined and preprogrammed into the switching system control unit 128. Therefore, the switching system control unit 128 may comprise a predetermined pulse width modulation table identifying a plurality of desired delta pilot pressures and corresponding target current outputs required for the first directional valve 224 and the second directional valve 226 to control the fluid flow to the first control element 240 and the second control element 242 of the variable position actuator valve 206. By way of example, and not limitation, the predetermined pulse width modulation table may be a lookup table or other table, which corresponds to the amount of current needed such that the delta pilot pressure applied to the first control element 240 and the second control element 242 may shift the variable position actuator valve 206 to the desired state. In addition, the table may contain the amount of delta pressure required to achieve the result of shifting the variable position valve to the desired state in a predetermined period of time. It should be appreciated that a plurality of pilot pressure transducers may be embedded within the components of the pilot hydraulic switching system 202, the hydraulic fluid handling system 204, and/or the like. The plurality of pilot pressure transducers may be configured to measure a current fluid pressure within the components of the pilot hydraulic switching system 202, the hydraulic fluid handling system 204, and/or the like.

The switching system control unit 128 may further be configured to determine whether the variable position actuator valve 206 will achieve one of the plurality of desired delta pilot pressures for the static state 200, the extend state 300, or the retract state 400 within a predetermined period of time. If the switching system control unit 128 determines that the one of the plurality of desired pilot pressures is not achievable, the switching system control unit 128 may shift the variable position actuator valve 206 to the static state 200. By way of example, and not limitation, one reason for the delta pressure to not be achieved may be due to a hydraulic fluid leak, which may be detected by one of the plurality of pressure transducers, or an electrical issue may be occurring.

The switching system control unit 128 may be further configured to determine the percentage amount of pulse width modulation required to achieve an actual current output required to achieve a target current output for the static state 200. As such, the switching system control unit 128 controls the first directional and the second directional valves 224, 226 such that the desired delta pilot pressure may be achieved to control the variable position actuator valve 206 to the static state 200. In some embodiments, the percentage amount of pulse width modulation required to achieve the actual current output may be how much current the first directional valve 224 and the second directional valve 226 each require such that both the first directional valve 224 and the second directional valve 226 maintain the neutral position 262. As such, maintaining the neutral position 262 of the first and second directional valves 224, 226 may keep the pilot pressure simultaneous and equal to both the first and the second control elements 240, 242. As such, the variable position actuator valve 206 may maintain the blocked flow path mode 256 such that the implement actuator 114 remains in the static positon.

The switching system control unit 128 may be configured to determine the percentage amount of pulse width modulation required to achieve an actual current output required to achieve a target current output for the extend state 300. As such, the switching system control unit 128 controls the first directional and the second directional valves 224, 226 such that the desired delta pilot pressure may be achieved to control the variable position actuator valve 206 to the extend state 300. In some embodiments, the percentage amount of pulse width modulation required to achieve the actual current output may be the amount of current that the first directional valve 224 and the second directional valve 226 each require such that the first directional valve 224 may be shifted to the delta net increase position 260 and the second directional valve 226 may be shifted to the delta net decrease position 264. For example, the pressure of fluid in both the retract pilot line 238 and the extend pilot line 236 may remain as simultaneously having pressure but with the net positive pressure in the extend pilot line 236 such that the first control element 240 may comprise a greater pressure than the second control element 242. This pressure differential may shift the variable position actuator valve 206 into the counter flow path mode 254 such that the implement actuator 114 may extend.

The switching system control unit 128 may be configured to determine the percentage amount of pulse width modulation required to achieve an actual current output required to achieve a target current output for the retract state 400. As such, the switching system control unit 128 controls the first directional and the second directional valves 224, 226 such that the desired delta pilot pressure may be achieved to control the variable position actuator valve 206 to the retract state 400. In some embodiments, the percentage amount of pulse width modulation required to achieve the actual current output may be the amount of current that the first directional valve 224 and the second directional valve 226 each require such that the second directional valve 226 may be shifted to the delta net increase position 260 and the first directional valve 224 may be shifted to the delta net decrease position 264. For example, the pressure of fluid in both the retract pilot line 238 and the extend pilot line 236 may remain as simultaneously having pressure but with the net positive pressure in the retract pilot line 238 such that the second control element 242 may comprise a greater pressure than the first control element 240. This pressure differential may shift the variable position actuator valve 206 into the opposing flow path mode 252 such that the implement actuator 114 may retract.

Referring now to FIG. 2, to achieve the static state 200, the first and second directional valves 224, 226 are configured to control fluid flow in the extend pilot line 236 and the retract pilot line 238 simultaneously and at an equal percent bias of a maximum pilot pressure against the first control element 240 and the second control element 242 of the variable position actuator valve 206 to control the variable position actuator valve 206 to the static state 200. For example, and not by way of limitation, each of the first and the second directional valves 224, 226 may be biased at an equal 50% of the maximum pilot pressure, thereby each of the first directional and the second directional valves 224, 226 may be in the neutral position 262.

With reference now to FIG. 3, to achieve the extend state 300, the first and the second directional valves 224, 226 are configured to control fluid flow in the extend pilot line 236 and the retract pilot line 238 simultaneously and oppositely to achieve the desired delta pressure such that the control of the variable position actuator valve 206 to the extend state 300 may be achieved when the desired delta pressure is satisfied. As such, the desired delta pressure may be a desired percentage of the delta net increase on the extend pilot line 236 and the desired delta net decrease on the retract pilot line 238. For example, and not by way of limitation, for a desired 5% delta pressure increase to achieve the extend state 300, the extend pilot line 236 may have an increase in fluid pressure, such as from 50% to the now increased desired delta pressure of 52.5% while the retract pilot line 238 may experience a decreased desired delta pressure such as from 50% to 47.5%. These changes in desired delta pressure may occur simultaneously such that a net 5% delta increase, or differential may occur in the extend pilot line 236 and on the first control element 240. Further, the delta pilot pressure may comprise a ratio that corresponds to how quickly the implement actuator 114 extends, a speed at which it extends, and/or a precision of the extension of the piston rod 222 of the implement actuator 114.

With reference to FIG. 4, to achieve the retract state 400, the first and the second directional valves 224, 226 are configured to control fluid flow in the extend pilot line 236 and the retract pilot line 238 simultaneously and oppositely to achieve the desired delta pressure such that the control of the variable position actuator valve 206 to the retract state 400 may be achieved when the desired delta pressure is satisfied. As such, the desired delta pressure may be a desired percentage of delta net increase 260 on the retract pilot line 238 and a desired delta net decrease 264 on the extend pilot line 236. For example, and not by way of limitation, for a desired 5% delta pressure increase to achieve the retract state 400, the retract pilot line 238 may comprise an increase in fluid pressure, such as from 50%, to a delta pressure of 52.5% while the extend pilot line 236 may decrease the desired delta pressure from 50% to 47.5%. These changes in the desired delta pressure may occur simultaneously such that a net 5% delta increase, or differential may occur in the retract pilot line 238 and on the second control element 242. Further, the delta pilot pressure may comprise a ratio that corresponds to how quickly the implement actuator 114 retracts, a speed at which it retracts, and/or a precision of the retraction of the piston rod 222 of the implement actuator 114.

Regarding the recitation herein of a "variable position" actuator valve, it is noted that the scope of this term is intended to cover valves that have at least three distinct fluid handling states and multiple port arrangements, as opposed to only three distinct fluid handling states and/or only a single port arrangement (i.e., only a four port arrangement).

It is noted that recitations herein of a component of the present disclosure being "configured" in a particular way, to embody a particular property, or to function in a particular manner, are structural recitations, as opposed to recitations of use or intended use. More specifically, the references herein to the manner in which a component is "configured" denotes an existing physical condition of the component and, as such, is to be taken as a definite recitation of the structural characteristics of the component.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A material moving machine comprising a machine chassis, an implement support assembly, a material moving implement coupled to the machine chassis via the implement support assembly, a hydraulic fluid handling system, a variable position actuator valve, and a pilot hydraulic switching system, wherein:

the implement support assembly comprises an implement actuator that is configured to move the material moving implement relative to the machine chassis;

the hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line;

the variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line;

the pilot hydraulic switching system comprises a switching system control unit, a first directional valve in fluid communication with the extend pilot line, and a second directional valve in fluid communication with the retract pilot line;

the switching system control unit is configured to operate the first directional valve and the second directional valve;

the first directional valve and the second directional valve are configured to shift the variable position actuator valve between a static state, a retract state, and an extend state;

in the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator;

in the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator, and in the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

2. The material moving machine of claim 1, wherein:

the material moving machine further comprises a translational chassis drive assembly that is configured to translate the material moving machine in a translational direction of operation; and the implement support assembly and the material moving implement are configured such that the material moving implement displaces material in an advancing path of the material moving implement as the material moving machine is translated by the drive assembly in the translational direction of operation.

3. The material moving machine of claim 2, wherein the advancing path of the material moving implement is parallel to the translational direction of operation of the material moving machine.

4. The material moving machine of claim 2, wherein:

the translational chassis drive assembly is configured to translate the material moving machine at a translational velocity of at least about 2 m/s in the translational direction of operation; and the variable position actuator valve and the pilot hydraulic switching system cooperate to shift the variable position actuator valve between the static state, the retract state, and the extend state as the material moving machine translates at the translational velocity.

5. The material moving machine of claim 1, wherein the implement actuator comprises an implement lift actuator or an implement pivot actuator.

6. The material moving machine of claim 1, wherein:

the implement actuator comprises an actuator cylinder; and the actuator cylinder is configured to move between extended and retracted positions in response to flow of hydraulic fluid into and out of the actuator cylinder by way of the first and second actuator lines.

7. The material moving machine of claim 1, wherein the first and second directional valves are fluidly coupled to the pump line with the pump port of the variable position actuator valve such that the first directional valve, the second directional valve, and the pump port of the variable position actuator valve are fluidly coupled to a common pump source.

8. The material moving machine of claim 1, wherein the first and second directional valves are fluidly coupled to the tank line with the tank port of the variable position actuator valve such that the first directional valve, the second directional valve, and the tank port of the variable position actuator valve are fluidly coupled to a common tank source.

9. The material moving machine of claim 1, wherein:

the first and second directional valves are fluidly coupled to the pump line with the pump port of the variable position actuator valve such that the first directional valve, the second directional valve, and the pump port of the variable position actuator valve are fluidly coupled to a common pump source; and the first and second directional valves are fluidly coupled to the tank line with the tank port of the variable position actuator valve such that the first directional valve, the second directional valve, and the tank port of the variable position actuator valve are fluidly coupled to a common tank source.

10. The material moving machine of claim 1, wherein the hydraulic fluid handling system, the variable position actuator valve, the first and second directional valves, and the implement actuator are configured to source hydraulic fluid from the hydraulic fluid pump and dispense hydraulic fluid to the hydraulic fluid tank.

11. The material moving machine of claim 1, wherein the variable position actuator valve comprises an opposing flow path mode, a counter flow path mode, and a blocked flow path mode.

12. The material moving machine of claim 1, wherein the switching system control unit is configured to:

complete a comparison of (i) a first target current output of the first directional valve to a first actual current output to the first directional valve via a first pulse width modulation percentage to the first directional valve to (ii) a second target current output to the second directional valve to a second actual current output to the second directional valve via a second pulse width modulation percentage of the second directional valve; and control the variable position actuator valve based on the comparison.

13. The material moving machine of claim 12, wherein the switching system control unit is configured to shift the variable position actuator valve to the static state when the comparison exceeds a predetermined failure threshold.

14. The material moving machine of claim 12, wherein the switching system control unit is configured to shift the variable position actuator valve to the static state when the first actual current output or the second actual current output fail to meet the first target current output or the second target current output.

15. The material moving machine of claim 12, wherein the switching system control unit is configured to:

determine an open or a short in the pilot hydraulic switching system based on determining the first pulse width modulation percentage or the second pulse width modulation percentage required for the first or the second actual current output required to achieve the first or the second target current output; and shift the variable position actuator valve to the static state when the open or the short is determined.

16. The material moving machine of claim 1, wherein the switching system control unit is configured to regulate a pilot hydraulic pressure of the pilot hydraulic switching system based on a predetermined target region for each of the static state, the retract state, and the extend state.

17. The material moving machine of claim 1, wherein the switching system control unit is configured to:

determine a first pulse width modulation percentage of the first directional valve and a second pulse width modulation percentage of the second directional valve as a percentage amount of pulse width modulation required to achieve a desired delta pilot pressure; and shift the variable position actuator valve to either the static state, the extend state or the retract state based on a predetermined target range.

18. The material moving machine of claim 17, wherein the switching system control unit is configured to:

determine whether the variable position actuator valve will achieve one of a plurality of desired delta pilot pressures for the static state, the retract state, or the extend state within a predetermined period of time; and shift the variable position actuator valve to the static state when the desired delta pilot pressure is not achievable within the predetermined period of time.

19. The material moving machine of claim 17, wherein the switching system control unit is configured to:

determine the percentage amount of pulse width modulation required to achieve an actual current output required to achieve a target current output for the static state, and control the first directional and the second directional valves such that the desired delta pilot pressure may be achieved to control the variable position actuator valve to the static state;

determine the percentage amount of pulse width modulation required to achieve an actual current output required to achieve a target current output for the retract state, and control the first directional and the second directional valves such that the desired delta pilot pressure for the retract state may be achieved to control the variable position actuator valve to the retract state; and determine the percentage amount of pulse width modulation required to achieve an actual current output required to achieve a target current output for the extend state, and control the first directional and the second directional valves such that the desired delta pilot pressure for the extend state may be achieved to control the variable position actuator valve to the extend state.

20. The material moving machine of claim 1, wherein:

the first directional valve and the second directional valves each further comprise a delta net increase position, a neutral position, and a delta net decrease position; and the switching system control unit is configured to control the first directional and the second directional valves to shift between the delta net increase position, the neutral position, and the delta net decrease position.

21. The material moving machine of claim 1, wherein the first directional valve and the second directional valve are configured to control fluid flow in the extend pilot line and the retract pilot line simultaneously and at an equal percent bias of a maximum pilot pressure against the first control element and the second control element of the variable position actuator valve to control the variable position actuator valve to the static state.

22. The material moving machine of claim 1, wherein the first directional valve and the second directional valve are configured to control fluid flow in the extend pilot line and the retract pilot line simultaneously and oppositely to achieve a desired delta pressure such that the control of the variable position actuator valve to the retract state is achieved when the desired delta pressure is satisfied.

23. The material moving machine of claim 1, wherein the first directional valve and the second directional valve are configured to control fluid flow in the extend pilot line and the retract pilot line simultaneously and oppositely to achieve a desired delta pressure such that the control of the variable position actuator valve to the extend state is achieved when the desired delta pressure is satisfied.

24. A bulldozer comprising:

a machine chassis, an implement support assembly, a translational chassis drive assembly configured to translate the material moving machine in a translational direction of operation, a material moving implement coupled to the machine chassis via the implement support assembly, a hydraulic fluid handling system, a variable position actuator valve, and a pilot hydraulic switching system, wherein:

the implement support assembly comprises an implement actuator that is configured to move the material moving implement relative to the machine chassis;

the implement support assembly and the material moving implement are configured such that the material moving implement displaces material in an advancing path of the material moving implement as the material moving machine is translated by the drive assembly in the translational direction of operation;

the hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line;

the variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line, the variable position actuator valve further comprises an opposing flow path mode, a counter flow path mode, and a blocked flow path mode;

the pilot hydraulic switching system comprises a switching system control unit, a first directional valve in fluid communication with the extend pilot line, and a second directional valve in fluid communication with the retract pilot line, the first directional valve and the second directional valves each further comprise a delta net increase position, a neutral position, and a delta net decrease position;

the switching system control unit is configured to operate the first directional valve and the second directional valve;

the first directional valve and the second directional valve are configured to shift between the delta net increase position, the neutral position, and the delta net decrease position such that the variable position actuator valve is shifted between a static state, a retract state, and an extend state;

the switching system control unit is configured to determine a first pulse width modulation percentage of the first directional valve and a second pulse width modulation percentage of the second directional valve as a percentage amount of pulse width modulation required to achieve a desired delta pilot pressure such that the switching system control unit is configured to shift the variable position actuator valve to either the static state, the extend state or the retract state based on a predetermined target range;

the switching system control unit comprises a predetermined pulse width modulation table identifying a plurality of desired delta pilot pressures and corresponding target current outputs required for the first directional valve and the second directional valve to control fluid flow into the first control element and the second control element of the variable position actuator valve;

the switching system control unit is configured to determine whether the variable position actuator valve will achieve one of the plurality of desired delta pilot pressures for the static state, the retract state, or the extend state within a predetermined period of time and shift the variable position actuator valve to the static state when the desired delta pilot pressure is not achievable within the predetermined period of time;

in the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator;

in the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator; and in the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

25. A material moving machine comprising a material moving implement, an implement actuator operatively coupled to the material moving implement, a hydraulic fluid handling system, a variable position actuator valve, and a pilot hydraulic switching system, wherein:

the hydraulic fluid handling system comprises a hydraulic fluid pump, a pump line fluidly coupled to the hydraulic fluid pump, a hydraulic fluid tank, a tank line fluidly coupled to the hydraulic fluid tank, a first actuator line fluidly coupled to the implement actuator, a second actuator line fluidly coupled to the implement actuator, an extend pilot line, and a retract pilot line;

the variable position actuator valve comprises a first control element fluidly coupled to the extend pilot line, a second control element fluidly coupled to the retract pilot line, a pump port fluidly coupled to the pump line, a tank port fluidly coupled to the tank line, a first actuator-side port fluidly coupled to the first actuator line, and a second actuator-side port fluidly coupled to the second actuator line;

the pilot hydraulic switching system comprises a switching system control unit, a first directional valve in fluid communication with the extend pilot line, and a second directional valve in fluid communication with the retract pilot line;

the switching system control unit is configured to operate the first directional valve and the second directional valve;

the first directional valve and the second directional valve are configured to shift the variable position actuator valve between a static state, a retract state, and an extend state;

in the static state, the first and second directional valves control fluid flow to the variable position actuator valve to drive pressurized fluid in the extend pilot line and the retract pilot line simultaneously and equally against the first control element and the second control element of the variable position actuator valve to hold a positional state of the material moving implement as controlled by the implement actuator;

in the retract state, the first and second directional valves control fluid flow to the variable position actuator valve to drive pressurized fluid in the extend pilot line and the retract pilot line simultaneously with a positive net pressure on the second control element of the variable position actuator valve and a negative net pressure on the first control element of the variable position actuator valve to retract the material moving implement under control of the implement actuator; and in the extend state, the first and second directional valves control fluid flow to the variable position actuator valve to drive pressurized fluid in the extend pilot line and the retract pilot line simultaneously with a positive net pressure of pressurized fluid on the first control element of the variable position actuator valve and a negative net pressure on the second control element of the variable position actuator valve to extend the material moving implement under control of the implement actuator.

* * * * *